US006592458B1

(12) United States Patent
Ho

(10) Patent No.: US 6,592,458 B1
(45) Date of Patent: Jul. 15, 2003

(54) GAMING SYSTEM INCORPORATING NON DETERMINISTIC JACKPOT

(75) Inventor: Oliver Ho, Victoria (AU)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 09/549,012

(22) Filed: Apr. 14, 2000

(Under 37 CFR 1.47)

(51) Int. Cl.[7] ..... A63F 3/06
(52) U.S. Cl. ..... 463/17; 463/25; 463/26; 463/27; 463/42; 273/138.2
(58) Field of Search ..... 463/25, 17, 18, 463/21, 26, 27, 42; 273/138.2

(56) References Cited

U.S. PATENT DOCUMENTS

| | | | | |
|---|---|---|---|---|
| 5,800,269 | A | * | 9/1998 | Holch et al. |
| 5,855,515 | A | * | 1/1999 | Pease et al. |
| 6,012,982 | A | * | 1/2000 | Piechowiak et al. ..... 463/16 |
| 6,168,521 | B1 | * | 1/2001 | Luciano et al. |
| 6,416,409 | B1 | * | 7/2002 | Jordan ..... 463/27 |
| 2001/0049303 | A1 | * | 12/2001 | Found et al. ..... 463/16 |

FOREIGN PATENT DOCUMENTS

| | | |
|---|---|---|
| NZ | 318340 | 4/1997 |
| NZ | 299589 | 6/1998 |

* cited by examiner

*Primary Examiner*—Benjamin H. Layno
(74) *Attorney, Agent, or Firm*—George H. Gerstman; Seyfarth Shaw

(57) ABSTRACT

A gaming system incorporating a non-deterministic jackpot is provided. In a first embodiment, the gaming system generates a random number to determine a probability of winning and a jackpot amount. A contribution rate is predetermined, and a portion of each bet placed on a gaming machine associated with the system equal to the contribution rate multiplied by the amount of the bet is placed in a contribution pool. The gaming machine on which a bet causing the contribution pool to be greater than or equal to the jackpot amount is awarded the jackpot. According to a second embodiment of the present invention, a first random number within a range is generated. A second random number is generated for each bet placed on a gaming machine associated with the system. The jackpot is awarded to a gaming machine on which a bet resulting in a second random number equal to the first random number was placed.

3 Claims, 2 Drawing Sheets

GAMING SYSTEM INCORPORATING NON DETERMINISTIC JACKPOT

FIELD OF THE INVENTION

The present invention relates to gaming machines but more particularly relates to a system for operating one or more electronic gaming machines such that payment of a jackpot to a player or group of players betting on one or more said gaming machines is an entirely random event. More particularly the present invention relates to a gaming control system involving use of one or more electronic gaming machines in which there is a relationship between the contribution to the jackpot (a bet) and selection of the winner. More particularly, the invention relates to a gaming control system in which each contribution to the jackpot from one or more electronic gaming machines has equal chance of winning wherein the process of selecting a winning contributor is an entirely random event.

BACKGROUND OF THE INVENTION

There are two existing systems which regulate jackpot payouts, the first of which is non-deterministic and the second of which is deterministic.

A non-deterministic jackpot is one where the payment of the jackpot is a random event such that each contribution is independent of any previous contributions. A deterministic jackpot is one in which the winning contributor is predetermined such that not all players have equal chance of winning. In the latter system there might be a selection of a number from a group of numbers which would win, in which case players not having that number would have no chance of winning. In a deterministic jackpot the process of selecting a winner is not based on the principle that each contributor has equal chance of winning.

Where a non-deterministic jackpot is employed in gaming machines, each machine operates in its own right such that each machine has the same chance of dropping a jackpot, Whilst the probability of occurrence is very low, in theory at least it would be possible for two machines to drop a jackpot at the same time.

Gaming machines traditionally pay jackpots to a player after a machine has been worked for a predetermined period of time. Generally, a machine will be programmed to make relatively small periodic payouts and to pay a jackpot after a long period of betting as the probability increases or after a shorter period of higher unit bets which increase the return to a player. This ensures a return to the proprietor of the machine and maintenance of player interest.

The modern machines allow a player a number of options in betting including selection of the number of lines for a payout display and the ability to increase the number of bets per line. An increase in the number of bets per line increases the chances of a payout. Existing gaming machines pay jackpots according to the betting history of the machine. Thus, depending how the machine is pre-programmed, the payout will be manipulated according to the betting history of the machine, which means that payment of a jackpot is not a random event but rather a predetermined event which can be altered by reprogramming the machine. To date, this has been an acceptable method of ensuring that a machine proprietor derives profit and advantage from its machines. However, non-random jackpot payments do not in some states quality as a tax deductible expense which reduces machine proprietor profits. For example, in some gaming jurisdictions, state tax rules deny tax deductability for non random or deterministic jackpots. The rationale behind this role is that where the frequency and level of jackpots can be manipulated so the payments are non-random, a proprietor could manipulate jackpots so as to increase tax deductions. A random jackpot is one that is paid as a random event independent of previous events or history of a particular gaming machine or group of machines.

In one prior art arrangement, a hidden winning figure may be kept in the system memory before start up and this is compared with a random figure, with matching determining the jackpot.

According to a non-deterministic arrangement, each machine in a group of machines has the same probability of paying a jackpot and the parameters behind the jackpot payout is entirely held within each machine unit. The machines are generally programmed to pay a jackpot depending on a display combination of symbols which is essentially a random event.

SUMMARY OF THE INVENTION

The present invention seeks to provide an alternative system for selecting a winning contributor involving random selection of a playing station or stations through which a jackpot is to be paid independent of the playing history of the station or stations. The invention represents a departure from conventional methods of selecting a winning contributor such that selections are always random and each contribution has equal chance of being selected. According to the known methods, jackpot payouts are deterministic based on event history in that the chances of winning a jackpot increased the more units bet per line. Thus, according to the prior art, the closer a player gets to the end range of the jackpot the more likely it will be won by that player.

According to the invention the contributor who will win the jackpot is selected by means remote from the gaming machines ensuring that at any one time there will be only one winner. Unlike the prior art system in which the winner is determined on a machine by machine basis and from within each machine the present invention utilizes a remote "brain" center which controls selection of a winning contribution.

According to the invention, a random number generator determines the outcome with no reference to the history of playing. Accordingly, the jackpot could go off at any time but the player will not necessarily increase his or her chances by establishing a long playing history in one session. In one broad form the present invention comprises: a gaming system for selecting a jackpot winner by random selection of a contributor playing a gaming machine or machines wherein, the selection of the jackpot winner is entirely random and independent of the playing history of the machine or machines.

In another broad form the present invention comprises: a gaming system for selecting a winning contributor, comprising at least one playing station, a controller in communication with said at least one playing station and which receives data from each said playing station, a random number generator in communication with said controller which responds to said data received by the controller from said at least one station and which determines which of said stations will win a jackpot.

In another broad form according to a method aspect, the present invention comprises: a method for setting up a gaming system in which selection of a winner playing at a station or stations of the gaming system is an entirely random event independent of the playing history of the station or stations, the method comprising the steps of:

a) taking at least one playing station capable of producing a contribution which can lead to a jackpot payout to a player;

b) connecting a controller to said at least one playing station;

c) connecting a random number generator to or including a random number generator in the controller;

d) entering jackpot parameters into said controller;

e) verifying correctness of said parameters;

f) allowing said controller to deduce a probability of a jackpot outcome based on data transmitted from said station/s in accordance with said jackpot parameters;

g) allowing each contribution to activate said random number generator via said controller;

h) allowing said random number generator to select a winning contributor;

i) following selection of a winning station, resetting the controller and delivering the reset value to said one or more stations.

In another broad form according to a method aspect, the present invention comprises:

a method for setting up a gaming system in which a selection of a winning station or stations is entirely random event independent of the playing history of the station or stations, the method comprising the steps of:

a) taking at least one playing station capable of producing a contribution to a jackpot payout to a player;

b) connecting a controller to said at least one playing station;

c) connecting a random number generator to or including a random number generator in the controller;

d) entering jackpot parameters into said controller;

e) verifying correctness of said parameters;

f) allowing said controller to deduce a probability of a jackpot outcome based on data transmitted from said station/s in accordance with said jackpot parameters such that the jackpot outcome represents a player having one chance in N of winning the jackpot per unit bet;

g) allowing each station to call said random number generator via said controller;

h) randomly selecting a jackpot winning station or stations responsive to a determination of said random number generator.

According to one embodiment of the present invention, a random number generator determines a value N as a probability of a win. Based on the probability, as represented by N, a jackpot amount is calculated. The system receives bets from individual gaming machines, and for each such bet, calculates the total amount in a contribution pool. When a bet is received that causes the contribution pool amount to equal the jackpot amount, the jackpot is awarded. The gaming machine on which the bet that caused the contribution pool amount to equal the jackpot amount receives the jackpot.

According to a further embodiment of the present invention, the probability N that a game will produce a jackpot outcome is determined. A random number generator chooses a first random number from 1 to N. The system receives bets from gaming machines interconnected thereto, and generates a second random number from 1 to N for each unit bet. The first selected random number is compared to the second random number. If the first random number is equal to the second random number, the jackpot is awarded to the machine which caused the matching second random number to be generated.

According to a preferred embodiment, the controller and random number generator are contained in a personal computer and are driven by a computer program.

DETAILED DESCRIPTION

The present invention will now be described in more detail according to [a] preferred but non-limiting embodiments.

Figure 1:
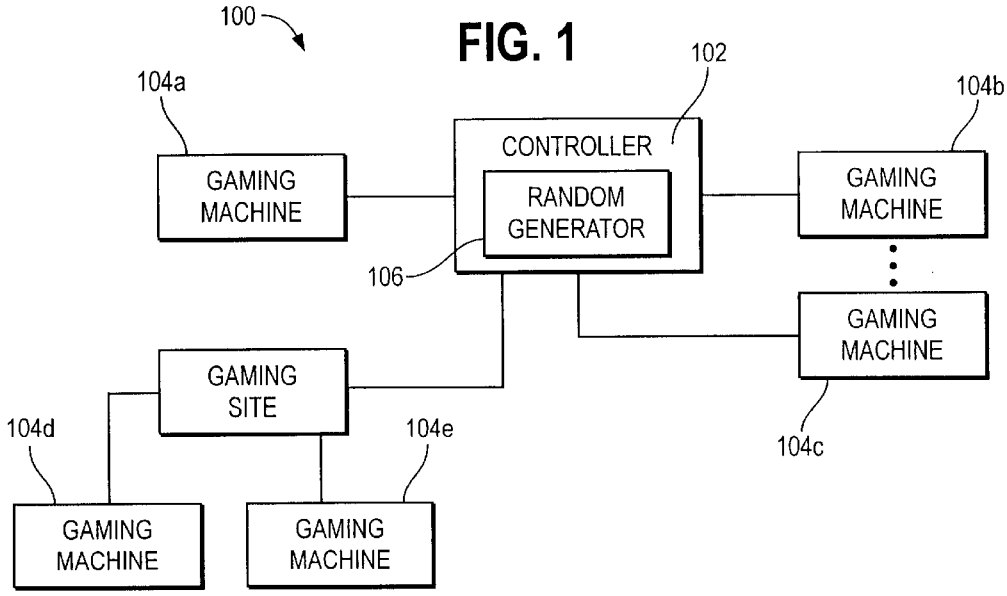
FIG. 1 is a schematic illustration of a gaming system according to the present invention.

With reference now to FIG. 1, a gaming system 100 according to the present invention is illustrated schematically. The gaming system 100 generally includes a controller 102 and a plurality of gaming machines 104*a–c*. Within or interconnected to the controller 102 is a random number generator 106. The system 100 may also include a gaming site 108, which serves to interconnect additional gaming machines 104*d* and 104*e*. Although the illustrated system 100 shows three gaming machines 104*a–c* connected thereto and two gaming machines 104*d*-3 connected to the gaming site 108, it should be understood that any number of gaming machines 104 may be used in connection with the present invention.

Figure 2:
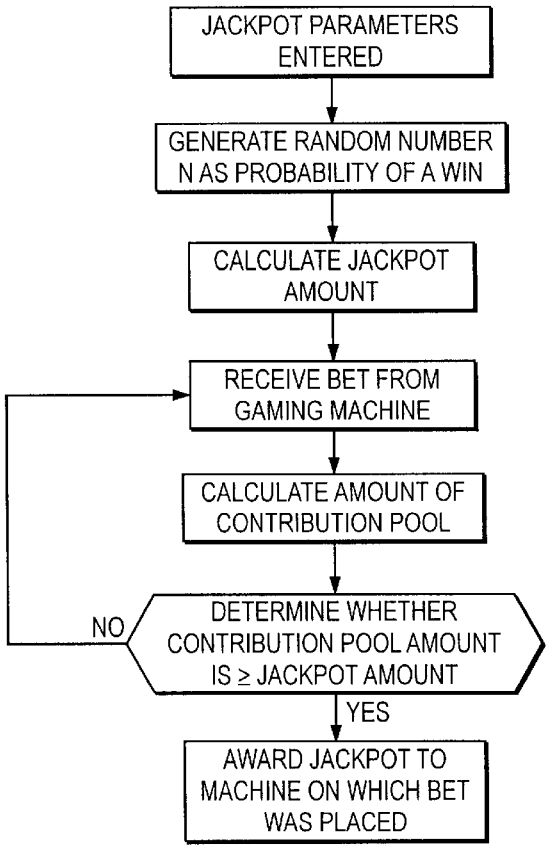
FIG. 2 is a flow chart of the method according to one embodiment of the present invention.

According to one embodiment of the present invention, and with reference now to FIG. 2, jackpot parameters are entered into the system 100 at step 200. Jackpot parameters in connection with this embodiment of the invention may include the range of numbers from which a value N may be selected, and a percentage amount of each bet placed on a gaming machine 104 that is added to the contribution pool.

Once the value N and the contribution amount have been determined, the jackpot amount can be calculated. For example N, which is related to the probability of a win, may be selected from a predetermined range of from 500 to 2000. If the N selected by the random number generator 106 is 1000, the contribution rate is set to 10%, and each bet is $1.00, then the jackpot would, for the given probability and contribution rate, be equal to $100.00 (step 204).

For each bet received 206, the amount in the contribution pool is calculated 208. The amount in the contribution pool is compared to the jackpot amount 210. Where the jackpot amount is equal to the contribution pool amount, the gaming machine 104 on which the bet causing the jackpot amount to equal the contribution amount was placed is awarded the jackpot 212.

Figure 3:
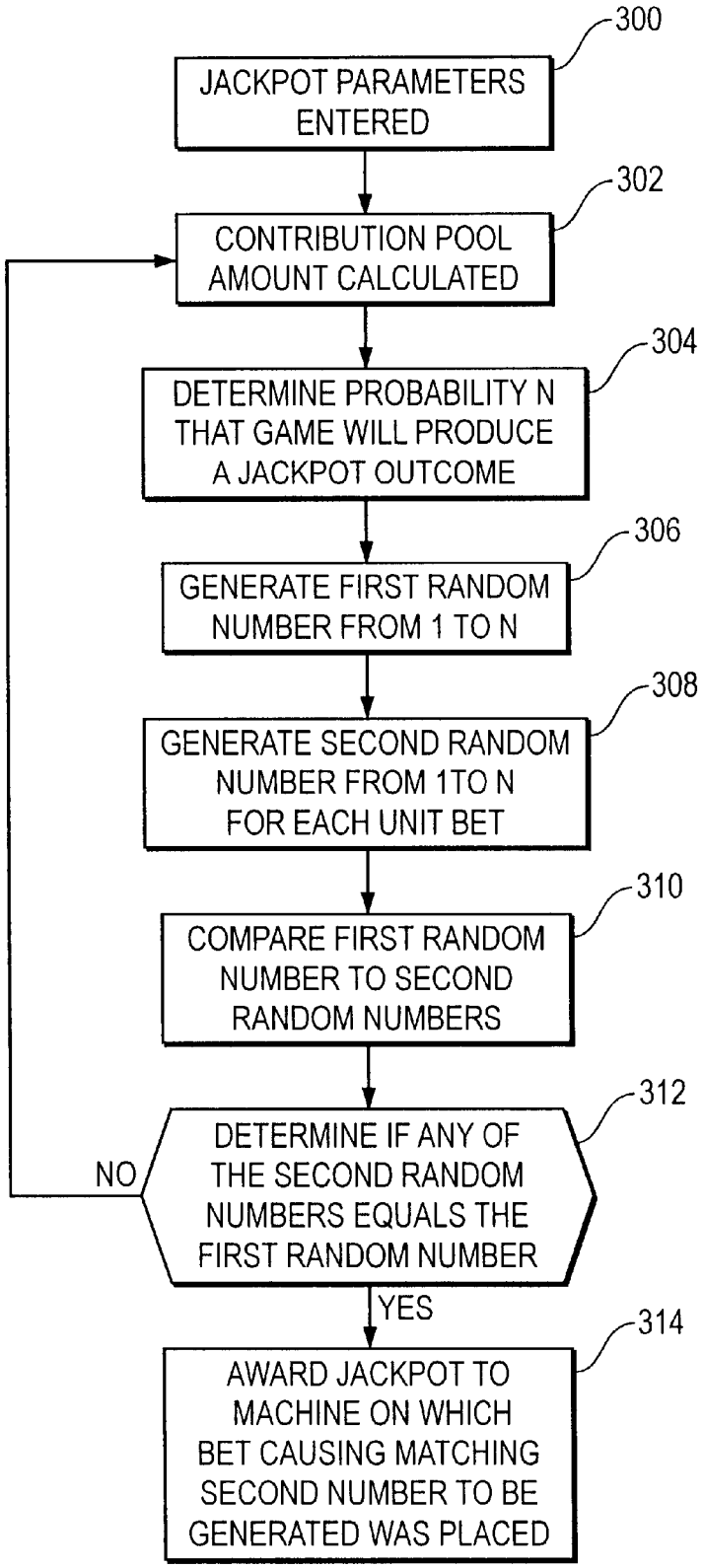
FIG. 3 is a flow chart of the method of another embodiment of the present invention.

With reference now to FIG. 3, according to yet another embodiment of the present invention, the jackpot parameters are entered 300, and the contribution pool amount calculated 302. The jackpot parameters include a reset value, a ceiling value, and a contribution rate. the reset value and the ceiling value represent minimum and maximum jackpot amounts respectively. As in the previous example, the contribution amount may be calculated as the sum of all bets placed on the system, multiplied by a contribution factor. At step 304, the probability N that a game will produce a jackpot outcome is calculated. Generally, N is calculated using the formula N=(ceiling value/contribution rate)×(multiplication factor).

At step 306, a first random number from 1 to N is generated. Next, at step 308, a second random number from 1 to N is generated for each unit bet on the gaming machines 104. The first selected random number is compared to the second random number at step 310. At step 312, the controller 102 determines if any second number is equal to the first random number. If a second random number is equal to the first random number, the jackpot, which is equal to the initial value plus contribution amounts, is awarded to the gaming machine 104 on which the bet resulting in the matching second random number was placed (step 314). If none of the second random numbers is equal to the first random number, the system returns to step 302, at which point subsequent bets are multiplied by the contribution rate, those amounts are added to the contribution pool, a new contribution pool amount is calculated, and the system continues through the remaining steps as described above. Generally, if no win is generated, the amount of the jackpot will increase until the ceiling value has been reached.

Where the system 100 includes gaming machines 104*a–e* associated with a gaming site 108, the system controller 102 may not have information regarding the particular gaming machine 104*d* or 104*e* that produced the winning result. In this case, the award to the winning gaming machine 104*d* or 104*e* is made through the gaming site 108, which maintains a record of bets placed on the gaming machines 104*d* and 104*e*, and which therefore can determine which of the gaming machines 104*d* or 104*e* placed the bet that resulted in the winning combination.

According to one embodiment, the present invention comprises a gaming system set up which allows a selection of a winning playing station or stations according to predetermined playing parameters which cause playing data to activate a controller which deduces a probability of the jackpot outcome such that it represents a player having one chance in N of winning the jackpot per unit bet. In the present context, random should be taken to mean an event not dependent upon or necessarily manipulated by previous events or history relating to the playing of a playing station other than jackpot parameters indicated below.

The jackpot parameters which are set include a reset value, a ceiling value, an initial value which may be the reset value or a value taken on a first jackpot run, a contribution rate indicated as a percentage the number of site groupings or groupings across multiple sites and electronic display groupings.

There are essentially three stages in the random jackpot gaining system, namely an initial stage, contribution stage and winning stage. In the initial stage once jackpot parameters have been entered and verified correct, the controller (or jackpot engine) will deduce the probability of the jackpot outcome which represents a player having one chance in N of winning the jackpot per unit bet where:

$$N=(\text{ceiling value}/\text{contribution rate})\times(\text{multiplication factor}).$$

A unit bet should be taken as a one cent bet or bet in any currency denomination.

After payment of a jackpot, the site controller will display the reset value or initial value on an associated electronic display. When a single or multiple site is played, the site controller which is linked to each station or group of stations will accept the turnover value or each station (machine) and relay the sum of all contributing stations to the jackpot engine as often as is required. The jackpot engine (controller) will add a percentage (being the predetermined jackpot parameter contribution rate) of the total turnover to the contribution pool to achieve a contribution pool value which is broadcast periodically to all participating sites and displayed. The jackpot engine will reconcile the total turnover in a periodical manner for accounting and site recovery purposes.

$$\text{Current pool}=(\text{reset or initial value})+S_0+S_1+S_2+S_3 \ldots S_{n-1}+S_n$$

where S=sum of turnover per site×percentage contribution for the jackpot level. Once the contribution values are set, each unit bet at a site causes the controller to call the random number generator which is the first step in the winning stage. The site or machine which wins the jackpot is that which contributes the winning unit which causes the random number jackpot to determine chance N as equal to zero.

The number of units to the winning unit is transmitted to the site to obtain the winning EGM that contributed the winning unit. The formula which governs the winning stage prior to resetting EGM Contribution that contributes to the winning site=$D_x$ in units where x=the EGM number that contributes to the jackpot.

$$\text{Winning site contribution}=D_{X-3}+D_{X-2}+D_{X-1}+D_X+D_{X+8}+D_{X+9}+D_{X+10}+D_{X+n}$$

where $D_{X+n}$=the last EGM that contributed to the winning contribution.

$$\text{Number of units to the winning unit}=D_{X-3}+D_{X-2}+D_{X-1}+D_X$$

After a jackpot is paid the jackpot engine will automatically reset and send the reset value to all sites. The reset value will be any denomination and applies to all machines in a group but the probability of a jackpot is equally shared proportionate to the unit contribution of each gaming machine.

An advantage of the invention is that it allows for delivery of random jackpots to multiple gaming machines within one site or to multiple machines at multiple sites. Furthermore, the system provides for multi-level jackpots which allows expansion of the existing four level jackpots which range from mini to grand level payouts It will be recognized by persons skilled in the art that numerous variations and modifications may be made to the invention as broadly described herein without departing from the overall spirit and scope of the invention.

The present invention, in various embodiments, includes components, methods, processes, systems and/or apparatuses substantially as depicted and described herein, including various embodiments, subcombinations, and subsets thereof. Those of skill in the art will understand how to make and use the present invention after understanding the present disclosure.

The present invention, in various embodiments, includes providing devices and processes in the absence of items not depicted and/or described herein, or in various embodiments hereof, including in the absence of such items as may have been used in previous devices or processes, e.g. for improving performance, achieving ease and/or reducing cost of implementation. The present invention includes items which are novel, in terminology adapted from previous and/or analogous technologies, for convenience in describing novel items or processes, does not necessarily retain all aspects of conventional usage of such terminology.

The foregoing discussing of the invention has been presented for purposes of illustration and description. The foregoing is not intended to limit to the invention to the form or forms disclosed herein. Although the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A gaming system which comprises the steps of:

generating a random number;

providing a contribution rate which comprises a percentage of each bet placed on gaming machines in a contribution pool;

calculating a jackpot amount, wherein said jackpot amount is calculated using said random number and using said contribution rate;

receiving bets from gaming machines in said contribution pool;

calculating an amount in said contribution pool, wherein said contribution pool amount is calculated using said contribution rate;

determining whether said contribution pool amount is greater than or equal to said jackpot amount; and awarding said jackpot to a gaming machine in which a bet causing said contribution amount to be greater than or equal to said jackpot amount was placed.

2. A system as defined in claim 1, in which said jackpot amount is calculated by multiplying said random number and said contribution rate.

3. A system as defined in claim 1, in which said contribution pool amount is equal to the sum of all bets placed on the gaming machines in said contribution pool, multiplied by said contribution rate.

* * * * *